US005820424A

United States Patent [19]

Steinhour et al.

[11] Patent Number: 5,820,424

[45] Date of Patent: Oct. 13, 1998

[54] ERGONOMICALLY IMPROVED KAYAK PADDLE

[75] Inventors: Derek A. Steinhour, Stevenson; Corran Addison, Seattle, both of Wash.

[73] Assignee: Adventure Technology, Inc., Stevenson, Wash.

[21] Appl. No.: 729,956

[22] Filed: Oct. 15, 1996

[51] Int. Cl.[6] ..... B63H 16/04

[52] U.S. Cl. ..... 440/101

[58] Field of Search ..... 440/101; 416/74; D12/215; D8/303, 310; 16/111 R

[56] References Cited

U.S. PATENT DOCUMENTS

| | | | |
|---|---|---|---|
| D. 217,939 | 6/1970 | Nochols . | |
| D. 297,927 | 10/1988 | Keal | D12/215 |
| D. 320,375 | 10/1991 | Bruce | D12/215 |
| 4,061,106 | 12/1977 | Ware | 115/24.1 |
| 4,605,378 | 8/1986 | Hamilton | 440/102 |
| 4,610,633 | 9/1986 | Freudenberg | 440/101 |
| 4,622,017 | 11/1986 | McGraw | 440/101 |
| 4,645,235 | 2/1987 | Joseph | 16/DIG. 12 |
| 4,820,216 | 4/1989 | Masters | 440/101 |
| 4,842,482 | 6/1989 | Beckerer, Jr. | 416/70 R |
| 4,955,839 | 9/1990 | Kaschper | 440/101 |
| 4,964,192 | 10/1990 | Marui | 16/111 R |

FOREIGN PATENT DOCUMENTS

| | | | |
|---|---|---|---|
| 2234932 | 2/1991 | United Kingdom | 440/101 |

OTHER PUBLICATIONS

Catalogue '94, Euro–Kayaks, p. 21.

*Primary Examiner*—Ed L. Swinehart
*Attorney, Agent, or Firm*—Sheridan Ross P.C.

[57] ABSTRACT

An ergonomically improved kayak paddle and a method for making the same is provided which improves the overall strength of the paddle while substantially reducing hand and arm fatigue for a user. The kayak paddle utilizes non-concentric gripping regions between a substantially longitudinal shaft and paddle blade sections. The gripping regions are interconnected to the shaft at non-abrupt predetermined angles of curvature and in a geometric configuration which reduces structural stress and fatigue at critical portions of the paddle while allowing a paddler to orient the paddle by touch alone.

12 Claims, 1 Drawing Sheet

2
4
6
8
10
12
14
16
18
20
22
24
26
30
32
34
36
θ1
θ2

ERGONOMICALLY IMPROVED KAYAK PADDLE

FIELD OF THE INVENTION

The present invention relates to an ergonomically improved kayak paddle which has gripping members shaped and oriented to conform to the closed hand of a user and to permit the user to determine the orientation of the paddle by touch alone.

BACKGROUND OF THE INVENTION

Kayak paddles are used to propel small watercraft such as canoes and more typically kayaks. The paddles generally consist of a relatively straight shaft with a blade interconnected on both ends. These type of paddles were originally constructed of wood poles with straight shafts and rudimentary blades nailed or glued to the shaft. With the development of plastics, fiberglass and other synthetic materials, modern kayak paddles are lighter, stronger and have improved geometric shapes to withstand the high degree of force and stress experienced by the paddler in severe whitewater conditions.

Due to the extreme forces, however, the paddles have still been found to break, primarily at the points of interconnection between the paddling blades and the substantially longitudinal shaft. The breaking of a paddle can be not only expensive, but potentially dangerous to a paddler in severe whitewater, where control of the kayak can be completely lost resulting in the capsizing of the kayak or a collision into rocks or other hazards.

Furthermore, modern kayak paddles have gripping areas which are generally concentric in shape and parallel to the axis of the blades when viewed in a cross-sectional plane. This type of geometric configuration can create severe hand and arm fatigue since the gripping area does not naturally conform to the hand or allow proper alignment of the joints and wrists, while making it more difficult for the user to determine the orientation of the kayak paddle blades by touch alone.

SUMMARY OF THE INVENTION

It is therefore an object of the present invention to provide a lightweight, durable kayak paddle having superior structural integrity at the points of interconnection between the paddle blades, the gripping area and the substantially straight shaft.

It is a further object of the present invention to provide a gripping area on the kayak paddle which is easier to hold, less stressful on the hands, joints and arms of the user, and which provides a shape which is easily identified and located by touch alone.

Accordingly, in one aspect of the present invention, a lightweight polyurethane, fiberglass and carbon fiber kayak paddle is provided which is comprised of a substantially longitudinal shaft interconnected to gripping members on both ends of the shaft. The gripping members are interconnected on the exterior ends to paddling blades which provide the surface area necessary to push the water and propel the kayak or other type of small watercraft. The gripping members are interconnected to both ends of the shaft at an angle greater than about 0° and less than about 45°, which prevents excessive stress and the likelihood of failure at the interconnection point. More preferably, the gripping members are interconnected to both ends of the shaft at angles between about 5° and 10°, and most preferably the gripping members are interconnected to both ends of the shaft at two different angles in different planes at angles between about 5° and 10°.

In yet another aspect of the present invention, an ergonomically shaped gripping area is provided which substantially conforms to the closed hand of a user gripping the paddle. The gripping members have a cross-sectional geometric shape having a substantially flat bottom surface, a substantially semi-circular shaped rear portion for engaging a palm of a user's hand, and a substantially oval front section for engaging the fingers of the paddler's hand. This geometric configuration allows the user of the kayak paddle to locate the gripping member and determine the orientation of the paddle by touch alone, while reducing fatigue in the arms and hands of a user.

In a further embodiment, the gripping member comprises a central portion which opposes the middle finger of a user of the kayak paddle and adjacent portions which oppose the last finger and thumb of the user. Preferably, the central portion of the gripping member has a greater circumference than the adjacent portions.

It is another object of the present invention to provide a method for making an improved kayak paddle which is less time consuming, more efficient and that allows the blade and paddle portions of the kayak paddle to be attached and molded together to form a homogeneous and structurally sound apparatus. Thus, in another aspect of the invention a method for making a stronger, ergonomically improved kayak paddle is provided which allows for the production of the aforementioned paddle in a more efficient, less time-consuming manner as compared to manufacturing processes for similar products. This process includes the steps of preparing a mold of the specified size and shape for the blade portion of the paddle and subsequently coating the blade mold surface with a non-stick fabric. A predetermined volume of polyurethane or similar foam material is mixed to a specified viscosity and temperature while the blade mold is preheated to a temperature of between about 100° F. and 150° F. More preferably, the blade mold is preheated to a temperature of about 125° F. The foam is then poured into the blade mold and the foam is allowed to cure for a sufficient time to solidify the blade core portion of the paddle. The blade mold is opened and the non-stick fabric is removed to disengage the blade core portion from the blade mold. A center section of the molded blade is then cut out and interconnected to an inflatable bladder. The inflatable bladder and the cut out portion of the blade mold is then covered with a carbon kevlar material and resin is applied to the various layers of carbon kevlar for bonding purposes. The cut out portion of the blade core is then reattached to the blade core and fiberglass in combination with a carbon fiber material used to cover and hence reinforce the blade portion and the interconnected shaft. The combined blade and shaft portion is then placed in a mold and pressure is applied to the shaft portion and the blade portion while the bladder is inflated, which in affiliation with the shaft mold, defines the geometric shape of the shaft portion of the kayak paddle. The shaft and blade are then heated for a sufficient period of time to solidify the resin on the fiberglass and carbon fiber at which time the inflatable bladder is deflated and the shaft and blade portion removed from the mold. As a final step, the shaft and blade portion are sanded or otherwise finished to create a smooth surface devoid of burrs or strands of fiberglass.

DETAILED DESCRIPTION OF THE PREFERRED EMBODIMENT

Figures 1, 2, 3, 4, 5:
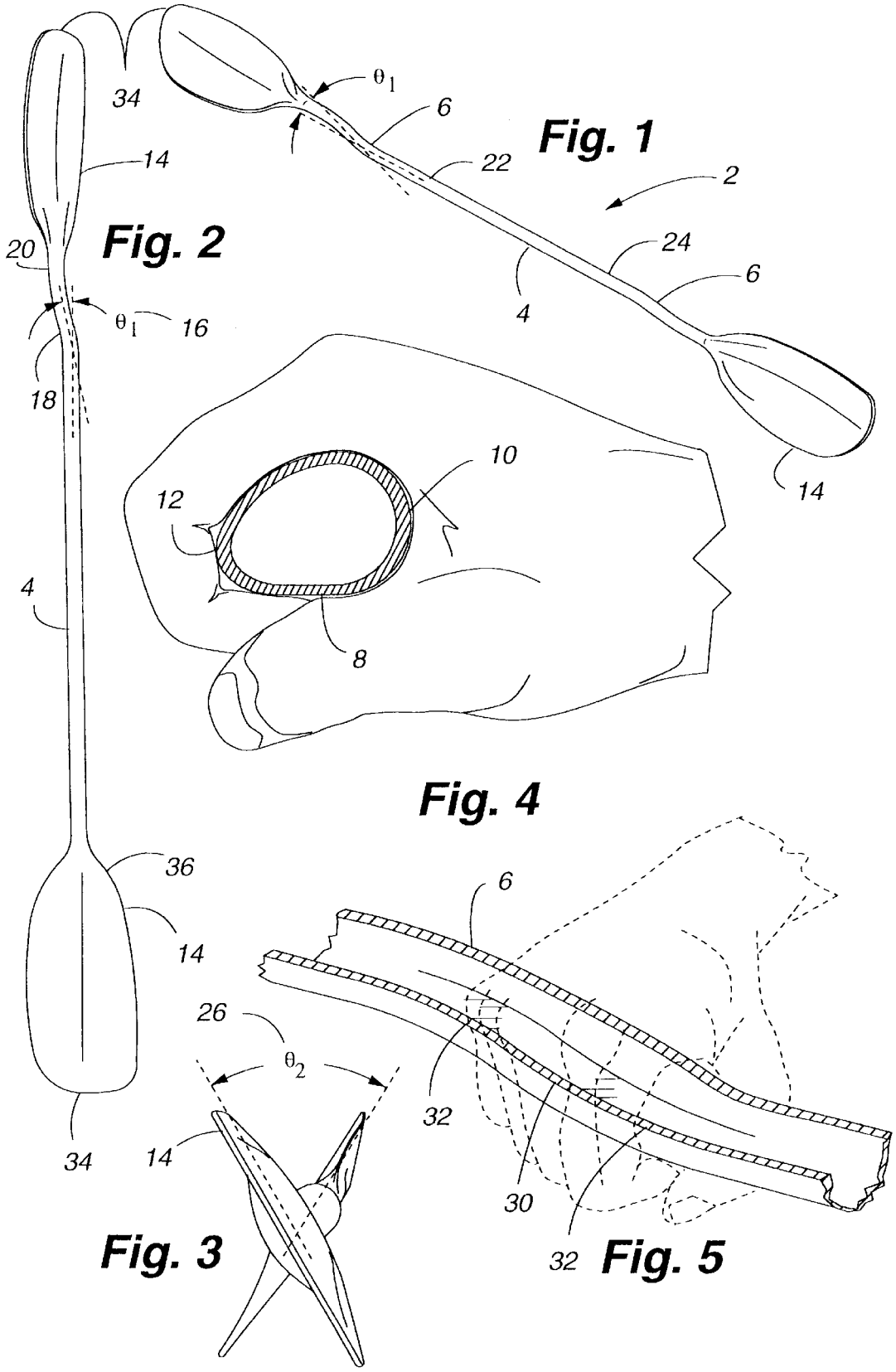
FIG. 1 is a front perspective view of an improved kayak paddle.
FIG. 2 is a top perspective view depicting the shaft, blades and gripping areas and orientation of these components.
FIG. 3 is an end view of the kayak paddle showing the orientation of the paddling blades and angles associated therewith.
FIG. 4 is a cross-sectional view of the gripping portion of the invention shown in FIG. 1–FIG. 3.
FIG. 5 is a cross-sectional top plan view of the gripping portion as identified in FIG. 4.

Referring now to FIGS. 1–5, an apparatus constructed in accordance with an embodiment of the present invention is generally identified by reference numeral 2. As shown, the ergonomically improved kayak paddle 2 is generally comprised of a substantially straight longitudinal shaft 4, gripping members 6 connected on both ends of the shaft and paddle blades 14 connected to the gripping members 6.

As seen in FIGS. 1 and 2, the substantially straight longitudinal shaft 4 has a first end 22 and a second end 24. Both the first end 22 and a second end 24 are interconnected to an interior end of a gripping member 18. The exterior ends 20 of the gripping members 18 are attached to the paddling blades 14 which provide the necessary surface area required to propel the watercraft.

In one aspect of the present invention the substantially longitudinal shaft 4 is adjoined to the interior ends 18 of the gripping members 6 at very subtle angles between about 0° and 45°. More preferably the attachment angle is between about 5° and 10°. Although these subtle angles are not easily seen in the drawings, the gripping members are preferably interconnected to the substantial longitudinal shaft 4 at an offset angle of about 5° in one direction and 10° in another direction. As seen in FIG. 2, the degree of angulation is defined as $\oplus_1$ and is measured by extending a centerline through the gripping members 6 and intersecting the substantially straight shaft section 4. Thus, the paddle will have two substantially equal angles where each of the interior ends 18 of the gripping members 6 are interconnected to the substantially straight shaft 4. The second defined angle (not shown in drawings) would extend directly into the page, in the "y" axis.

The attachment angles 16 are predetermined when the mold for making the longitudinal shaft 4 is constructed. These subtle geometric curves provide the paddler with a greater degree of comfort and less arm and hand fatigue as compared to paddles which are substantially straight or have abrupt, high angle offsets or bends between the substantially straight shaft 4 and the blades 14. Perhaps more importantly, the subtle curved design of the attachment angles 16 provides stronger structural integrity to the present paddle, as compared to paddles designed with a high degree of offset, since a major portion of the structural stress occurs at the attachment point between the gripping member 6 and the longitudinal shaft. Thus the kayak paddle of the present invention is capable of withstanding significantly more stress without structural failure as compared to kayak paddles which are designed with a greater offset and angulation.

Referring now to FIG. 3, an end view of a paddle is shown with the blade offset angle $\oplus_1$ defined between the blades as numeral 26. The blade offset angle $\oplus_2$ is important given that it provides the paddler greater control due to a reduction in the rotation of the paddle between alternating strokes. A paddler can have the blade offset angle $\oplus_1$ custom made depending on preference and the physical characteristics of the user. Preferably, the blade offset angle 26 $\oplus_1$ is between about 0 degrees and 90 degrees, depending on the preference of the user and the type of conditions for which the paddle will be used. More preferably, the blade offset angle 26 $\oplus_1$ is about 45° degrees.

Referring now to FIG. 4, a cross-sectional view of the gripping portion of the present invention is shown with the hand of a paddler depicted in a normal position of use. As seen, the gripping member 6 is generally hollow and comprised of an oval front section 12, a flat bottom portion 8, and a semi-circular rear portion 10. As the gripping member 6 is held within the hand of a paddler, preferably the gripping member 6 conforms naturally to the closed hand. That is, the semicircular rear portion 10 conforms to the palm of the hand when in a gripping position. Likewise, the flat bottom portion 8 of the gripping member 6 conforms to the end of the fingers while the oval front section 12 conforms to the closed fingers of the hand. The cross-sectional oval and egg shape serves two important functions. First, the distinct shape and orientation reduces overall hand and arm fatigue since the hand is closed in its natural position, as opposed to concentric or oblong designs which are unnatural for a closed hand. Furthermore, the distinct shape of the gripping members 6 allows the paddler to determine the position of the kayak paddle and orientation of the blades by touch alone. This factor is important in severe whitewater conditions where a paddler may be capsized in water for extended periods of time or may be in a completely inverted position and attempting to right the kayak. In these situations the paddler is unable to look at the orientation of the paddle and must rely on touch alone to determine the position of the paddle for proper use. In a further embodiment of the present invention, finger grips may be provided so that indents fit each individual finger and are molded directly into the gripping members 6 (not shown).

Referring now to FIG. 5, a view depicting the front view of the gripping area 6 connected to the substantially straight longitudinal shaft 4 is shown. Preferably, the gripping member 6 is constructed with a central portion 30 which substantially opposes the middle finger of a user's hand, and adjacent portions 32 which substantially oppose the user's thumb and small finger. As illustrated, the central portion 30 of the gripping member 6 has a greater circumference than the adjacent portions 32, which helps reduce hand and arm fatigue and allows the user to determine the orientation of the paddle more readily and by touch alone. In a preferred embodiment, the circumference of the gripping area which opposes a user's middle finger has a dimension of about 3.875 inches, while the circumference of the gripping area which opposes the user's thumb and small finger has a dimension of about 3.750 inches.

In another aspect of the present invention, an improved method is provided for fabricating a kayak paddle with greater strength than most commercially available kayak paddles. This method includes the steps of utilizing a mold of a predetermined shape for both the paddle blade 14 and longitudinal shaft 4 sections, the shaft 4 section generally including the gripping members 6 discussed previously. Although the shaft 4 portion and blade 14 portions are constructed initially in an independent fashion, the blade 14 and shaft 4 are assembled and molded together in a final process step which creates a homogenous paddle of improved strength. Thus, fiberglass material extends down the entire length of the shaft and through the paddle blade 14 to within 1–3 inches of the blade tip 34.

Generally, the method includes the steps of utilizing a mold for both the paddle blade 14 section and the shaft 4 section. An adhesive spray such as a 3M 77 is sprayed into the blade 14 mold to allow placement of a non-stick fabric, more commonly known as "peel ply", which is a tightly woven, low permeability polyester fabric manufactured by Precision Fabrics Group, Inc. in Greensboro, N.C. The fabric is utilized to remove the blade 14 from the mold without sticking. A fiberglass reinforcement material is then positioned near the blade tip 14 and edges of the blade. A predetermined volume of a low density foam material such as polyurethane is poured into the preheated blade mold at approximately room temperature. The blade 14 mold is maintained at a temperature of preferably between about 115° F. and 140° F., and more preferably at 125° F. for a period of between about 12 and 15 minutes, or until the foam is sufficiently cured. The mold is then opened and the foam core blade 14 with fiberglass reinforcement removed with the non-stick "peel-ply" type polyester fabric.

A center portion of the paddle blade core 14 is then cut out from the blade base 36 to approximately 1"–3" from the blade tip 34, and more preferably 2 inches. This blade cutout portion is then attached to an inflatable bladder having a shape which allows the bladder to be inserted into a longitudinal shaft 4 mold. The bladder is preferably made of a non-stick synthetic material such as rubber, and more preferably silicone rubber. The bladder and the blade cutout portion are then wrapped with a plurality of layers of fiberglass material which are wet with a resin type bonding material to adhere the various layers of fiberglass together and interconnecting to the paddle blade 14, which has been reattached to the paddle blade cutout portion. For reinforcement, the layers of fiberglass and resin are extended downward over the blade base 36 and to within 1"–3" from the blade tip 34.

The blade 14 and a portion of the longitudinal shaft 4 are then covered with a carbon fiber material such as Hexcel 282, which is manufactured by Hexcel Company in Seguin, Tex. for strength. The entire shaft 4 and blade 14 is then placed into the shaft and blade molds where an external pressure of between about 4 and 6 tons is applied in conjunction with internal shaft pressure of 90 psi at a temperature between about 160° F. and 170° F. for approximately 20 minutes.

The inflatable bladder is then deflated and the interconnected paddle shaft and blade removed from the mold. In one embodiment of the present invention, the kayak paddle is molded in two symmetrical left and right identical sections which are interconnected with a ferrule sleeve which fits within the longitudinal shaft 4 at a midway point between the two paddle blades 14. As a final step, the exterior surfaces of the shaft 4 and blade 14 are trimmed and sanded for a more finished appearance.

While various embodiments of the present invention have been described in detail, it is apparent that further modifications and adaptations of the invention will occur to those skilled in the art. However, it is to be expressly understood that such modifications and adaptations are within the spirit and scope of the present invention. For clarity, the numbering of the various components identified in the figures are provided herein:

| | |
|---|---|
| 02 kayak paddle | 20 gripping member exterior end |
| 04 longitudinal shaft | 22 shaft first end |
| 06 gripping member | 24 shaft second end |
| 08 flat bottom portion | 26 blade offset angle |
| 10 semi-circular rear portion | 28 blade stem |
| 12 oval front section | 30 central portion |
| 14 blade | 32 adjacent portion |
| 16 attachment angle | 34 blade tip |
| 18 gripping member interior end | 36 blade base |

What is claimed is:

1. An ergonomically shaped kayak paddle comprising:

a shaft having a longitudinal axis and first and second ends, said first and second ends each having respective first and second blades associated therewith;

a first gripping member interconnecting said first blade with said first end, wherein said first gripping member is oriented with respect to said longitudinal axis at a first predetermined angle;

a second gripping member interconnecting said second blade with said second end, wherein said second gripping member is oriented with respect to said longitudinal axis at a second predetermined angle, wherein said first and second gripping members are positioned about said longitudinal axis so as to be in different planes;

at least said first gripping member comprises a cross-sectional geometric configuration having:

(a) a substantially flat bottom surface;

(b) a substantially semi-circular shaped rear portion for engaging a palm of a user's hand;

(c) a substantially oval front section for engaging the fingers of said user's hand; and (d) a top surface having a reduced curvature in comparison to said rear portion of said at least said first gripping member.

2. The kayak paddle of claim 1, wherein said first and second gripping members substantially conform to the closed hand of said user of said kayak paddle.

3. The kayak paddle of claim 1, wherein for each of said first and second gripping members, the gripping member includes a central portion which substantially engages a middle finger of a user's hand when gripping said gripping member, wherein said central portion has an enlarged gripping area of said gripping member, that contacts a majority of the middle finger of a user's hand.

4. The kayak paddle of claim 3, wherein a circumference of said central portion of each said first and second gripping members is at least about 1 percent larger than a circumference of an adjacent portion of said gripping member.

5. The kayak paddle of claim 1, wherein said shaft, said gripping members and said blades are comprised of at least one of: plastic, fiberglass, polyurethane, and carbon fiber.

6. The kayak paddle of claim 1, wherein each of said first and second gripping members have an interior end and an exterior end, said interior end affixed to one of said first and second ends of said shaft at an angle greater than about 0 degrees and less than about 20 degrees, said angle measured from said longitudinal axis of said shaft.

7. The kayak paddle of claim 1, wherein said blades are oriented with respect to one another at a cross-sectional offset angle of between about 0 degrees and 90 degrees.

8. The kayak paddle of claim 1, wherein said first and said second predetermined angles are oriented with respect to said longitudinal axis of said shaft in a range of between about 5° to 10°.

9. An ergonomically shaped kayak paddle comprising:

a substantially straight shaft having a first end, a second end and a longitudinal axis;

gripping members having an interior end and an exterior end, said interior end affixed to said first and second ends of said shaft at a predetermined angle greater than about 0 degrees and less than about 45 degrees, said angle measured from said axis of said shaft; and a blade affixed to each of said exterior ends of said gripping members wherein at least one of said gripping members has a cross-sectional shape that allows a user to determine a correct orientation of said blades by tactilely sensing a curvature of at least one of said gripping members, wherein at least one of said gripping members further comprises: (a) a central portion having an enlarged gripping area for contacting a majority of the middle finger of a kayak user's hand when gripping said central portion, and (b) an adjacent portion wherein said adjacent portion substantially engages the user's small finger and thumb, and wherein said central portion has a circumference at least about 1 percent greater than said adjacent portion.

10. The kayak paddle of claim 9, wherein said gripping members have a total length of less than about 6 inches.

11. The kayak paddle of claim 9, wherein said shaft, said gripping members and said blades are comprised of at least one of: plastic, fiberglass, carbon kevlar, polyurethane foam and nylon fiber.

12. A kayak paddle having a substantially longitudinal shaft with a first end and a second end and blades operably attached to each of said ends, comprising:

gripping members positioned between said shaft and said blade, said gripping members comprising:

(a) a cross-sectional geometric configuration having a substantially flat bottom surface, (b) a substantially semi-circular shaped rear portion for engaging a palm of a user's hand, (c) a substantially oval front section for engaging the fingers of said user's hand, and (d) a top surface having a reduced curvature in comparison to a curvature of a portion of said gripping member adjacent the user's palm;

whereby a user can properly orient said paddle by touch alone.

* * * * *